US011235182B2

(12) United States Patent
Wang et al.

(10) Patent No.: US 11,235,182 B2
(45) Date of Patent: Feb. 1, 2022

(54) END OF SERVICE LIFE INDICATOR FOR DISPOSAL MASK

(71) Applicant: Honeywell International Inc., Morris Plains, NJ (US)

(72) Inventors: Li Wang, Shanghai (CN); Xiang Zhu, Shanghai (CN); Yuzheng Lu, Shanghai (CN)

(73) Assignee: Honeywell International Inc., Morristown, NJ (US)

( * ) Notice: Subject to any disclaimer, the term of this patent is extended or adjusted under 35 U.S.C. 154(b) by 720 days.

(21) Appl. No.: 15/508,860

(22) PCT Filed: Sep. 5, 2014

(86) PCT No.: PCT/CN2014/085977
§ 371 (c)(1),
(2) Date: Mar. 3, 2017

(87) PCT Pub. No.: WO2016/033790
PCT Pub. Date: Mar. 10, 2016

(65) Prior Publication Data

US 2017/0281991 A1 Oct. 5, 2017

(51) Int. Cl.
*A62B 9/00* (2006.01)
*A41D 13/11* (2006.01)
(Continued)

(52) U.S. Cl.
CPC ..... *A62B 9/006* (2013.01); *A41D 13/11* (2013.01); *A41D 13/1138* (2013.01);
(Continued)

(58) Field of Classification Search
CPC ..... A62B 9/006; A62B 18/02; A62B 23/025; A41D 13/11; A41D 13/1138; A41D 2500/30
(Continued)

(56) References Cited

U.S. PATENT DOCUMENTS 2,577,606 A 12/1951 Conley
4,146,887 A 3/1979 Magnante
(Continued)

FOREIGN PATENT DOCUMENTS

CA 2628699 A1 10/2009
CN 200969877 Y 11/2007
(Continued)

OTHER PUBLICATIONS

PCT/CN2014/085977, PCT International Search Report, dated Jun. 3, 2015, 3 pages.
(Continued)

*Primary Examiner* — Keri J Nelson
(74) *Attorney, Agent, or Firm* — Alston & Bird LLP

(57) ABSTRACT

Embodiments relate generally to methods and systems for detecting and indicating end-of-service-life in disposable filtration masks. Applicant has proposed incorporating end-of-service-life indicators comprising color changing chemicals into the mask. The indicating chemicals may be incorporated into the nonwoven fabric material of the mask, or may be attached to the nonwoven material of the mask, such as by dipping, spraying, or adhering. The color change of the indicating chemicals may indicate to a user that the use life of the mask has been depleted.

16 Claims, 3 Drawing Sheets

(51) Int. Cl.
*A62B 18/02* (2006.01)
*A62B 23/02* (2006.01)

(52) U.S. Cl.
CPC ..... *A62B 18/02* (2013.01); *A62B 23/025* (2013.01); *A41D 2500/30* (2013.01)

(58) Field of Classification Search
USPC ..... 128/863
See application file for complete search history.

(56) References Cited

U.S. PATENT DOCUMENTS

| | | | |
|---|---|---|---|
| 4,154,586 | A | 5/1979 | Jones et al. |
| 4,155,358 | A | 5/1979 | McAllister |
| 4,200,092 | A | 4/1980 | Warncke et al. |
| 4,365,627 | A | 12/1982 | Wing |
| 4,488,547 | A | 12/1984 | Bowers, Jr. |
| 4,530,706 | A | 7/1985 | Jones |
| 4,886,058 | A | 12/1989 | Brostrom et al. |
| 5,012,805 | A | 5/1991 | Muckerheide |
| 5,158,077 | A | 10/1992 | Sundstrom |
| 5,165,395 | A | 11/1992 | Ricci |
| 5,666,949 | A | 9/1997 | Debe et al. |
| 5,776,213 | A | 7/1998 | Flaherty et al. |
| 5,861,053 | A | 1/1999 | Noritake et al. |
| 6,375,725 | B1 | 4/2002 | Bernard et al. |
| 6,497,756 | B1 | 12/2002 | Curado et al. |
| 6,944,842 | B1 | 9/2005 | Trimberger |
| 6,979,361 | B2 | 12/2005 | Mihaylov et al. |
| 7,118,608 | B2 | 10/2006 | Lovell |
| 7,442,237 | B1 | 10/2008 | Gardner |
| 7,749,303 | B2 | 7/2010 | Wright |
| 7,927,558 | B2 | 4/2011 | Kirollos et al. |
| 7,992,426 | B2 | 8/2011 | Fleischer et al. |
| 8,574,331 | B2 | 11/2013 | Bangera et al. |
| 9,011,584 | B2 | 4/2015 | Tobias et al. |
| 2006/0201513 | A1 | 9/2006 | Chu |
| 2008/0056946 | A1 | 3/2008 | Ahmad |
| 2008/0119753 | A1 | 5/2008 | Ricciardelli et al. |
| 2010/0294272 | A1 | 11/2010 | Holmquist-Brown et al. |
| 2010/0294274 | A1 | 11/2010 | Poirer et al. |
| 2013/0047982 | A1 | 2/2013 | Tobias et al. |

FOREIGN PATENT DOCUMENTS

| | | | |
|---|---|---|---|
| CN | 201219517 | Y | 4/2009 |
| CN | 102458583 | A | 5/2012 |
| CN | 102458585 | A | 5/2012 |
| CN | 202436167 | U | 9/2012 |
| CN | 107072338 | A | 8/2017 |
| DE | 3613512 | A1 | 10/1987 |
| DE | 9407866 | U1 | 7/1994 |
| DE | 4329031 | A1 | 9/1994 |
| EP | 2747843 | A2 | 7/2014 |
| EP | 3188612 | A1 | 7/2017 |
| EP | 2747843 | B1 | 10/2017 |
| JP | 2011-030706 | A | 2/2011 |
| WO | 94/19056 | A1 | 9/1994 |
| WO | 9612523 | A1 | 5/1995 |
| WO | 2008145988 | A1 | 12/2008 |
| WO | 20098029426 | A1 | 3/2009 |
| WO | 2013028981 | A2 | 2/2013 |
| WO | 2016033790 | A1 | 3/2016 |

OTHER PUBLICATIONS

PCT/CN2014/085977, PCT Written Opinion of the International Searching Authority, dated Jun. 3, 2015, 4 pages.
PCT/US2012/052287, Invitation to Pay Additional Fees and Partial International Search Report dated Sep. 3, 2013, 5 pages.
PCT/US2012/052287, International Search Report dated Oct. 28, 2013, 6 pages.
PCT/US2012/052287, Written Opinion of the International Searching Authority dated Oct. 28, 2013, 12 pages.
PCT/US2012/052287, International Preliminary Report on Patentability dated Feb. 25, 2014, 13 pages.
U.S. Appl. No. 13/420,186, Restriction Requirement, dated Apr. 1, 2014, 7 pages.
U.S. Appl. No. 13/420,186, Office Action, dated Jun. 12, 2014, 7 pages.
U.S. Appl. No. 13/420,186, Final Office Action, dated Aug. 1, 2014, 11 pages.
U.S. Appl. No. 13/420,186, Notice of Allowance, dated Dec. 10, 2014, 9 pages.
Europe Patent Application No. 12753653.0, Examination Report, dated Apr. 1, 2014, 2 pages.
Europe Patent Application No. 12753653.0, Examination Report, dated Mar. 2, 2016, 5 pages.
U.S. Appl. No. 13/420,186, Advisory Action, dated Sep. 25, 2014, 3 pages.
Europe Patent Application No. 12753653.0, Intention to Grant, dated Apr. 5, 2017, 26 pages.
Europe Patent Application No. 12753653.0, Decision to Grant, dated Sep. 14, 2017, 2 pages.
PCT/CN2014/085977, International Preliminary Report on Patentability, dated Mar. 7, 2017, 5 pages.
China Patent Application No. 201480083155.4, First Office Action, dated Jul. 17, 2018, 17 pages.
Europe Patent Application No. 14901177.7, Extended European Search Report, dated Oct. 9, 2018, 8 pages.
CN Office Action dated Jul. 31, 2020 for CN Application No. 201480083155.
English Translation of CN Office Action dated Jul. 31, 2020 for CN Application No. 201480083155.
CN Office Action dated Apr. 16, 2020 for CN Application No. 201480083155.
CN Office Action dated Mar. 27, 2019 for CN Application No. 201480083155.
CN Search report dated Apr. 9, 2020 for CN Application No. 201480083155.
CN Search report dated Mar. 19, 2019 for CN Application No. 201480083155.
English Translation of CN Office Action dated Apr. 16, 2020 for CN Application No. 201480083155.
English Translation of CN Office Action dated Mar. 27, 2019 for CN Application No. 201480083155.
Anonymous, "methyl orange, 360U1234569495, 360 baike", Sep. 3, 2014, [certifying document, online], [retrieved Dec. 3, 2020], retrieved from the Internet <https://baike.so.com/doc/history/id/3092525>, (7 pages).
Anonymous, "methyl red, cttest_029, 360 baike", Jul. 3, 2014, [certifying document, online], [retrieved Dec. 3, 2020] retrieved from the Internet <https://baike.so.com/doc/history/id/2571049> (6 pages).
Anonymous, "Bromocresol green, cttest_026, 360 baike", Jun. 12, 2014, [certifying document, online], [retrieved Dec. 3, 2020], retrieved from the Internet <https://baike.so.com/doc/history/id/2239124> (8 pages).
CN Office Action, including Search Report, dated Dec. 11, 2020 for CN Application No. 201480083155, including Search Report.
English Translation of CN Office Action, including Search Report, dated Dec. 11, 2020 for CN Application No. 201480083155.
Xie, Mingxue, "Litmus", 2012, Jul. 30, 2014, [certifying document, online], [retrieved Dec. 3, 2020], retrieved from the Internet <https://baike.baidu.com/history/%E7%9F%B3%E8%95%8A/614568/63944568> (4 pages).
Communication from the Examining Division dated Nov. 25, 2021 for EP Application No. 14901177, 6 pages.

END OF SERVICE LIFE INDICATOR FOR DISPOSAL MASK

CROSS-REFERENCE TO RELATED APPLICATIONS

This application claims priority as the National Stage of International Application No. PCT/CN2014/085977 filed on Sep. 5, 2014 and entitled to END OF SERVICE LINE INDICATOR FOR DISPOSAL MASK, which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Personal protection equipment (PPE), specifically disposable masks, may be required to conform to certain regulations during design and manufacture. The user's ability and ease of breathing while wearing the mask may be considered, as well as the fit and the comfort of the user who may wear the mask. PPE, such as disposable masks or reusable cartridges, may comprise filtration media, which may be made of melt-blown fibers and/or micro glass material. Filtration by a mask is accomplished when particles in the air are trapped in the matrix of the fibers contained in the filtration media of the mask.

SUMMARY

Aspects of the disclosure may include embodiments of a disposable mask comprising: an interior surface, located proximate to a user's face; an exterior surface, located opposite to the interior surface; a filtering nonwoven fabric material; and an end of service life indicator comprising one or more indicator chemicals incorporated into the nonwoven fabric material, wherein: the indicator chemicals change color to indicate end of service life of the mask; and the indicator chemicals react with a user's exhaled breath to change color.

In some embodiments, the indicator chemicals may be located on a strip and the strip may be incorporated into the nonwoven fabric material by attaching to the interior surface of the mask. In some embodiments, the indicator chemicals may be incorporated into the nonwoven fabric material by dipping the nonwoven fabric material into the indicator chemicals. In some embodiments, the indicator chemicals may be incorporated into the nonwoven fabric material by spraying the indicator chemicals onto at least one surface of the mask. In some embodiments, the indicator chemicals may be incorporated into the nonwoven fabric material by adding fibers of the indicator chemicals into the forming process of the nonwoven fabric material. In some embodiments, the forming process of the nonwoven fabric material may comprise one of: spinbonding, electrospinning, or meltblowing. In some embodiments, the indicator chemicals may comprise at least one of: a pH indicator, litmus, bromophenol blue, bromothymol blue, methyl violet, cresol red, thymol blue, methyl yellow, methyl red, natural red, methyl orange, bromocresol green, phenolphthalein, chlorophenol red, and allochroic silica gel. In some embodiments, the indicator chemicals may react with carbon dioxide exhaled in a user's breath. In some embodiments, the indicator chemicals may react with water exhaled in a user's breath. In some embodiments, the indicator chemicals may react with water and carbon dioxide exhaled in a user's breath. In some embodiments, the mask may further comprise a reference color strip attached to the mask, wherein end of service life is indicated when the color change of the indicator chemicals matches the reference color strip.

Additional aspects of the disclosure may include embodiments of a disposable mask comprising: a filtering nonwoven fabric material; and an end of service life indicator comprising one or more indicator chemicals incorporated into the nonwoven fabric material, wherein: the indicator chemicals change color to indicate end of service life of the mask; the indicator chemicals react with water and carbon dioxide exhaled in a user's breath; and the indicator chemicals comprise at least one of: a pH indicator, litmus, bromophenol blue, bromothymol blue, methyl violet, cresol red, thymol blue, methyl yellow, methyl red, natural red, methyl orange, bromocresol green, phenolphthalein, chlorophenol red, and allochroic silica gel.

In some embodiments, the indicator chemicals may be located on a strip and the strip is incorporated into the nonwoven fabric material by attaching to the interior surface of the mask. In some embodiments, the indicator chemicals may be incorporated into the nonwoven fabric material by applying the indicator chemicals to the surface of the already formed nonwoven fabric material. In some embodiments, the indicator chemicals may be incorporated into the nonwoven fabric material by adding fibers of the indicator chemicals into the forming process of the nonwoven fabric material. In some embodiments, the forming process of the nonwoven fabric material may comprise one of: spinbonding, electrospinning, or meltblowing.

Other aspects of the disclosure may include embodiments of a method for determining end of service life for a disposable face mask, the method comprising: determining a correlation between the exhalation from a user and the use life of the mask; incorporating color changing indicator chemicals into the disposable face mask; determining a color change standard for the color changing indicator chemicals at the end of the use life of the mask; and monitoring the reaction of the color changing indicator chemicals with one of water and carbon dioxide from a user's exhalation to determine end of service life.

In some embodiments, the method may further comprise installing a color reference strip onto the disposable masks, wherein the color reference strip may comprise the determined color change standard. In some embodiments, the color changing indicator chemicals may comprise one or more of: a pH indicator, litmus, bromophenol blue, bromothymol blue, methyl violet, cresol red, thymol blue, methyl yellow, methyl red, natural red, methyl orange, bromocresol green, phenolphthalein, chlorophenol red, and allochroic silica gel. In some embodiments, incorporating color changing indicator chemicals into the disposable face mask may comprise adding fibers of the indicator chemicals into the forming process of the mask.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments relate generally to disposable filtration masks comprising end-of-service-life indicators. Typical disposable and/or reusable filters for respirators may be constructed of nonwoven fabric materials, and maybe operable to filter particles in the air moving both directions during inhalation and exhalation by a user or wearer. After a certain wear time or use life, the filtration capabilities of the disposable mask may be depleted, possibly due to accumulation of filtered particles in the nonwoven fabric.

Applicant has proposed methods for detecting and indicating end-of-service-life for disposable masks by incorporating color changing chemicals into the mask. The indicating chemicals may be incorporated into the nonwoven fabric material of the mask, or may be attached to the nonwoven material of the mask, such as by dipping, spraying, or adhering. The color change of the indicating chemicals may indicate to a user that the use life of the mask has been depleted.

Figure 1:
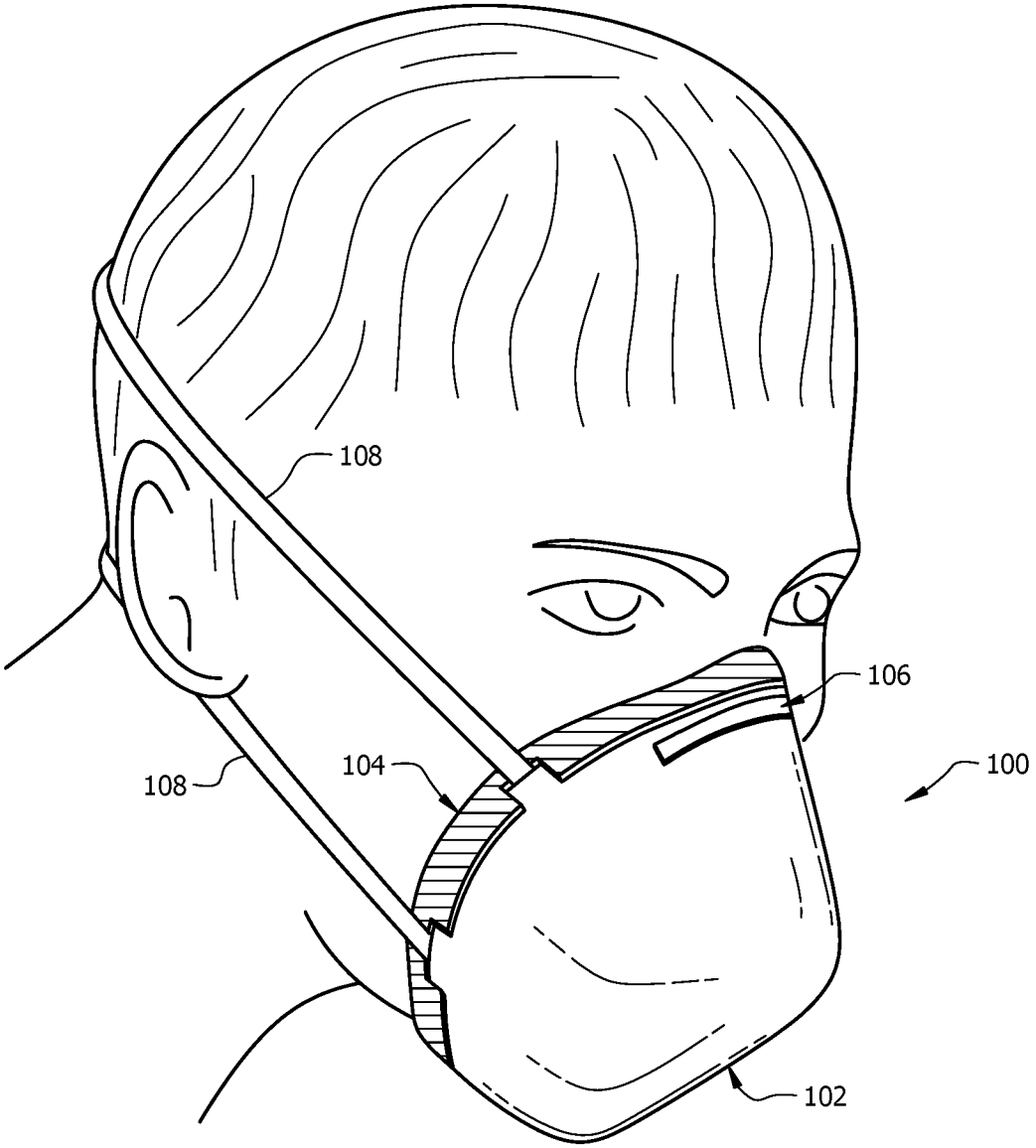
FIG. 1 illustrates an exemplary disposable face mask.

Referring to FIG. 1, an exemplary face mask 100 is shown. The mask 100 may comprise an exterior surface 102 and an interior surface 104. In some embodiments, the mask 100 may include elements for holding the mask to a user's face, such as straps 108 and a nose clip 106. In some embodiments, the mask may comprise a nonwoven fabric material.

Figure 2:
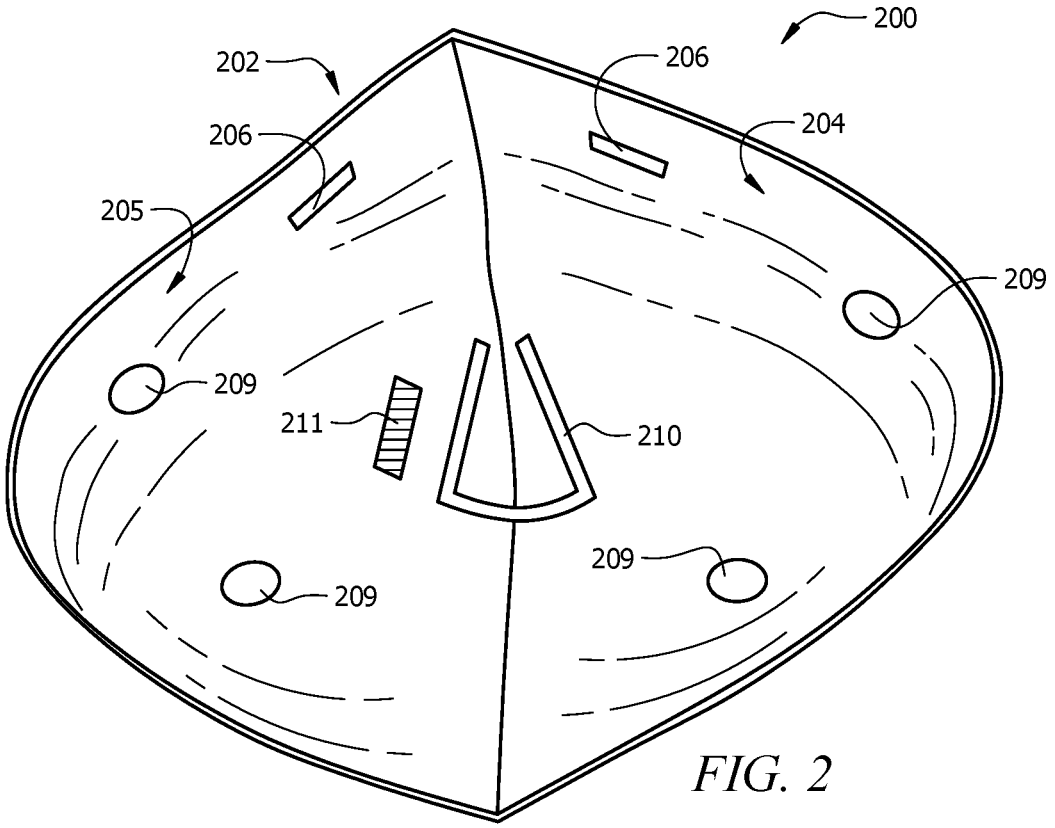
FIG. 2 illustrates an embodiment of a disposable mask comprising an end of service life indicator.

FIG. 2 illustrates an exemplary embodiment of a face mask 200 comprising an end-of-service-life indicator (ESLI) 210. The mask 200 may comprise a nonwoven fabric material 205. In the embodiment of FIG. 2, the ESLI 210 may be located on the interior surface 204 of the mask 200. In some embodiments, the ESLI 210 may indicate end-of-service-life of the mask 200 by reacting with a user's exhaled breath, for example the water and/or carbon dioxide exhaled by a user. Although the mask 200 may be used to filter harmful chemicals from the air to protect the user, the amount of carbon dioxide and/or water exhaled by the user may be correlated to the use life of the mask. For example, the amount of exhaled breath may be related to the time the mask has been worn by the user, and thereby the time the mask has been used for filtering particles form the air. Therefore, the carbon dioxide and/or water may be measured by the ESLI 210 by reaction with indicator chemicals, which may change color for example, to indicate the end-of-service-life for the mask 200. In some embodiments, the determined use life of a disposable mask 200 may be customized based on the specific needs for user, including what particles will be filtered by the mask, the location of the user when wearing the mask, etc.

In some embodiments, the ESLI 210 may comprise strips containing indicator chemicals, wherein the strips may be attached to the interior surface 204 of the mask 200. In some embodiments, the strips of the ESLI 210 may comprise a rectangular shape, as shown in FIG. 2, while in other embodiments the ELSI 210 may comprise strips of any shape (such as circular, rounded, rectangular, square, semi-circular, etc.) that may be operable to attach to the interior surface 204 of the mask 200. Additionally, the strips of the ESLI 210 of FIG. 2 may comprise a small shape relative to the size of the mask 200, but any size strip that accomplishes the same purpose may be used for the ESLI 210. The strips may be attached by stapling, pinning, adhering, gluing, or any other attachment method. In some embodiments, the ESLI 210 may comprise litmus or other pH indicators, such as bromophenol blue, bromothymol blue, methyl violet, cresol red, thymol blue, methyl yellow, methyl red, natural red, methyl orange, bromocresol green, phenolphthalein, and chlorophenol red, operable to indicate the pH of the air flowing through the mask 200 from the exhalations of the user. The color change of the pH indicators may be affected by the amount of carbon dioxide and/or water in the air flowing from the interior surface 204 to the exterior surface 202 of the mask. In some embodiments, the ESLI 210 may comprise other chemicals, including silica compounds such as allochroic silica gel. In some embodiments, a reference color strip 211 may be provided, possibly attached to the mask, to indicate the color that the ESLI 210 will reach at the end-of-service-life. In some embodiments, the mask 200 may comprise elements 209 for attaching straps (similar to straps 108) as well as elements 206 for attaching a nose strip (similar to nose strip 106).

Figure 3:
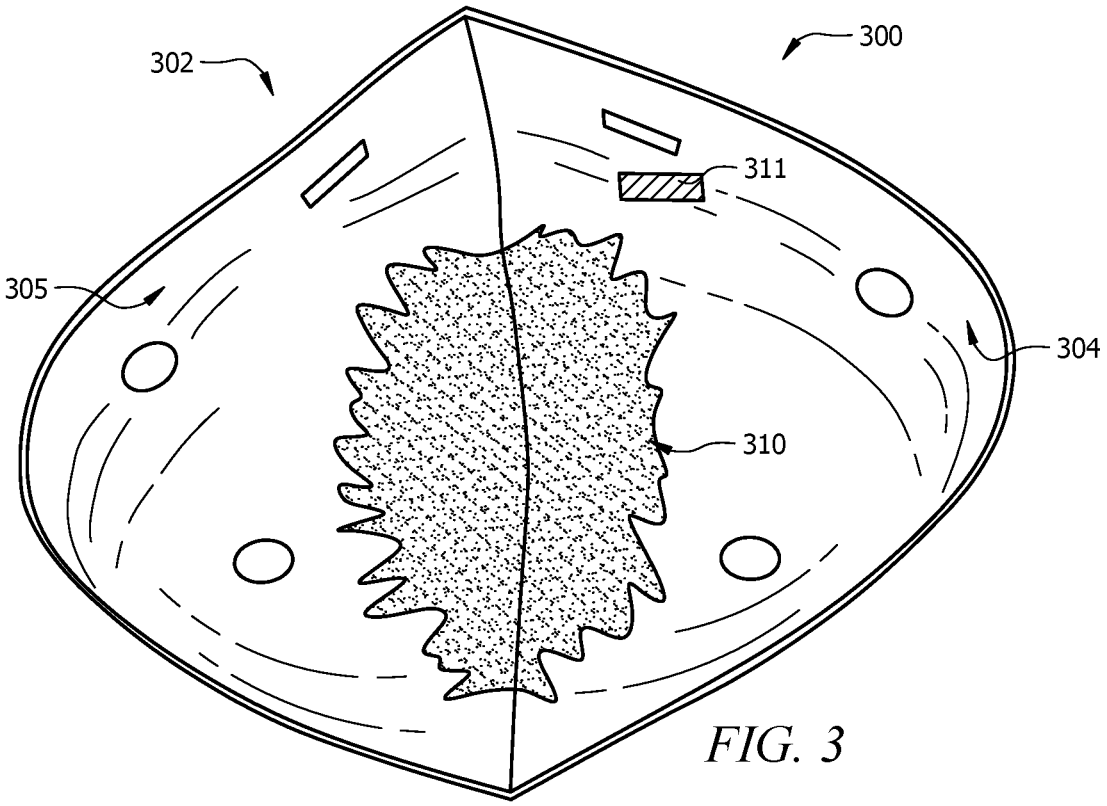
FIG. 3 illustrates another embodiment of a disposable mask comprising an end of service life indicator.

FIG. 3 illustrates another exemplary embodiment of a disposable face mask 300 comprising a color changing ESLI 310. The mask 300 may comprise a nonwoven fabric material 305. In the embodiment of FIG. 3, the indicator chemicals of the ESLI 310 may be incorporated into the material of the mask 300. This may be accomplished by spraying the indicator chemicals onto at least one of the interior surface 304 or exterior surface 302 of the mask 300 or dipping the mask 300 into the indicator chemicals. In some embodiments, the indicator chemicals may be incorporated into the mask material during the formation of the mask material, such as by spinbonding, electrospinning, or meltblowing, for example. The indicator chemicals may be added to the nonwoven material when the fibers of the material are formed. In some embodiments, a reference color strip 311 may be provided, possibly attached to the mask, to indicate the color that the ESLI 310 will reach at the end-of-service-life.

In some embodiments, the indicator chemicals of the ESLI 310 may be located on only a portion of the interior surface 304 and/or exterior surface 302. In some embodiments, the indicator chemicals may cover at least a fourth of the surface area of the mask 300.

Figure 4:
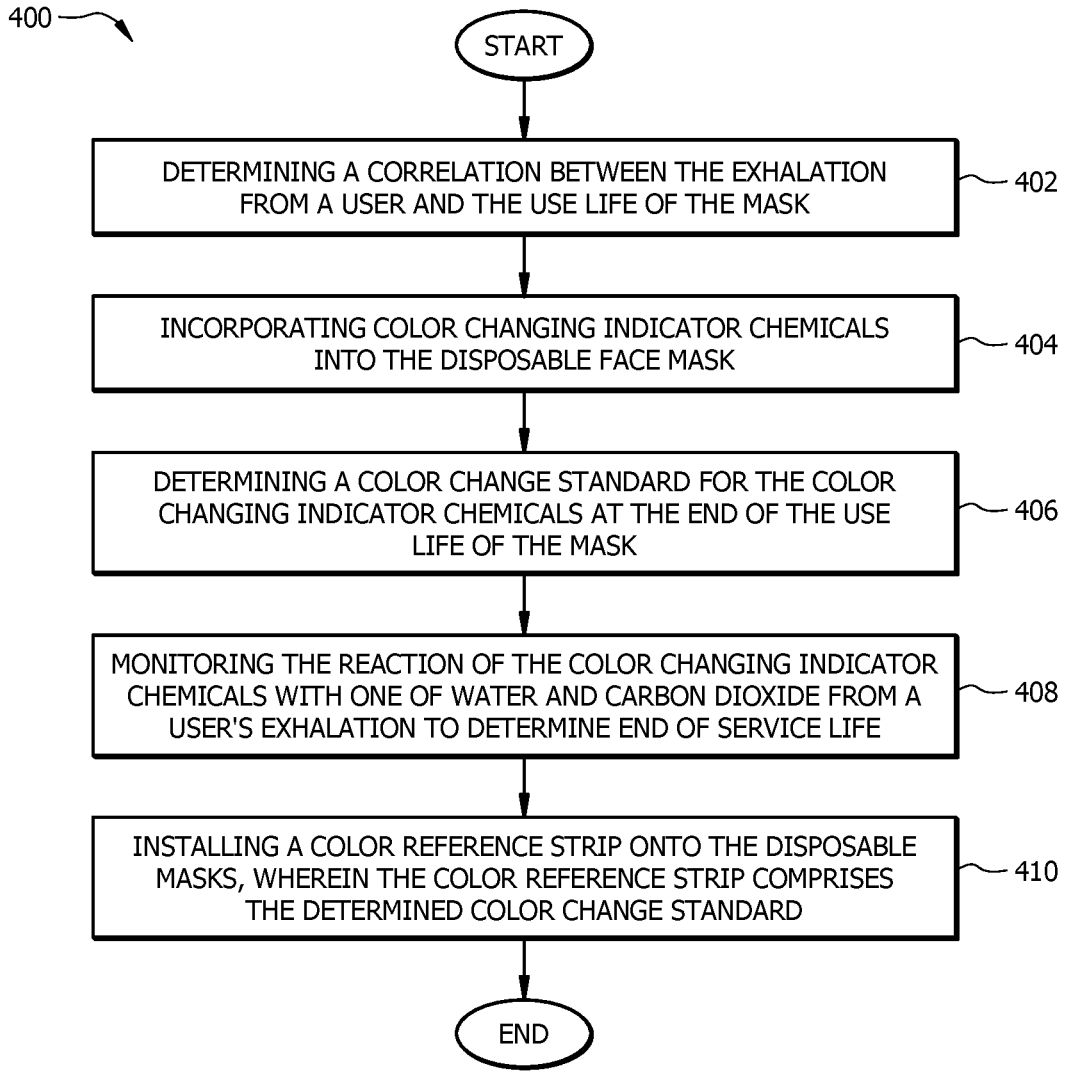
FIG. 4 illustrates a method for determining end of service life for a disposable face mask.

Referring now to FIG. 4, some embodiments of the disclosure may include a method 400 for determining the end-of-service-life for a disposable face mask. At step 402, a correlation may be determined between the exhalation from a user and the use life of the mask. At step 404, color changing indicator chemicals may be incorporate into the disposable face mask. At step 406, a color change standard may be determined for the color changing indicator chemicals at the end of the use life of the mask. At step 408, the reaction of the color changing indicator chemicals with one of water and carbon dioxide from a user's exhalation may be monitored to determine end of service life. In some embodiments, at step 410, a color reference strip may be installed onto the disposable masks, wherein the color reference strip may comprise the determined color change standard. In some embodiments, the color changing indicator chemicals may comprise one or more of: a pH indicator, litmus, bromophenol blue, bromothymol blue, methyl violet, cresol red, thymol blue, methyl yellow, methyl red, natural red, methyl orange, bromocresol green, phenolphthalein, chlorophenol red, and allochroic silica gel. In some embodiments, incorporating color changing indicator chemicals into the disposable face mask may comprise adding fibers of the indicator chemicals into the forming process of the mask.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A disposable particulate filtration mask comprising:

an interior surface, configured to be located proximate to a user's face;

an exterior surface, located opposite to the interior surface;

a particulate filtering nonwoven fabric material; and an end of service life indicator, located on the interior surface, comprising one or more indicator chemicals incorporated into the particulate filtering nonwoven fabric material, wherein:

the one or more indicator chemicals change color in a way correlating to an indication of end of service life of the particulate filtering nonwoven fabric material, wherein use life of the disposable particulate filtration mask is customizable based on at least one of particles to be filtered by the disposable particulate filtration mask and a location of a user when wearing the disposable particulate filtration mask;

the one or more indicator chemicals are configured to react with a user's exhaled breath to change color, wherein the one or more indicator chemicals comprise at least one of: a pH indicator, litmus, methyl red, methyl orange, bromocresol green, and phenol; and a reference color strip indicator is attached to the interior surface of the disposable particulate filtration mask, wherein the end of service life of the particulate filtering nonwoven fabric material is indicated when the color change of the one or more indicator chemicals matches the reference color strip, wherein the reference color strip comprises a color change standard.

2. The disposable particulate filtration mask of claim 1, wherein the one or more indicator chemicals are configured to react with carbon dioxide in the user's exhaled breath, and the end of service life indicator is configured to correlate carbon dioxide to the end of service life of the disposable particulate filtration mask.

3. The disposable particulate filtration mask of claim 1, wherein the one or more indicator chemicals are configured to react with water in the user's exhaled breath, and the end of service life indicator is configured to correlate water to the end of service life of the disposable particulate filtration mask.

4. The disposable particulate filtration mask of claim 1, wherein the one or more indicator chemicals are located on a strip and the strip is incorporated into a nonwoven fabric material by attaching to the interior surface of the disposable particulate filtration mask.

5. The disposable particulate filtration mask of claim 4, wherein the one or more indicator chemicals are applied to the interior surface of the nonwoven fabric material.

6. The disposable particulate filtration mask of claim 1, wherein particles filtered by the disposable particulate filtration mask are harmful chemicals.

7. A method for determining end of service life for a disposable particulate filtration face mask, the method comprising:

determining a correlation between exhalation from a user and the end of service life of the disposable particulate filtration face mask;

incorporating color changing indicator chemicals on an interior surface of the disposable particulate filtration face mask, wherein the color changing indicator chemicals comprise at least one of: a pH indicator, litmus, methyl red, methyl orange, bromocresol green, and phenol;

determining a color change standard for the color changing indicator chemicals at the end of service life of the disposable particulate filtration face mask, wherein use life of the disposable particulate filtration mask is customizable based on at least one of particles to be filtered by the disposable particulate filtration mask and a location of the user when wearing the disposable particulate filtration mask;

installing a color reference strip onto the interior surface of the disposable particulate filtration face mask, wherein the color reference strip comprises the color change standard; and monitoring a reaction of the color changing indicator chemicals with one or more of water and carbon dioxide from the exhalation to determine the end of service life.

8. The method of claim 7, wherein the color changing indicator chemicals are located on a strip and the strip is incorporated into a nonwoven fabric material by attaching to the interior surface of the disposable particulate filtration face mask.

9. The method of claim 7, wherein the indicator chemicals are incorporated into a nonwoven fabric material by dipping the nonwoven fabric material into the indicator chemicals.

10. The method of claim 7, wherein the indicator chemicals are incorporated into a nonwoven fabric material by adding fibers of the indicator chemicals into a forming process of the nonwoven fabric material.

11. The method of claim 7, wherein determining the correlation between the exhalation and the end of service life of the disposable particulate filtration face mask comprises correlating an amount of one or more of carbon dioxide and water reacting with the color changing indicator chemicals with the exhalation.

12. The method of claim 11, further comprising correlating exhalation breaths from the user to accumulation of filtered particles on a particulate filtering nonwoven fabric material of the disposable particulate filtration face mask, such that the color changing indicator chemicals are indirectly correlated to the end of service life of the disposable particulate filtration face mask due to the accumulation of filtered particles.

13. The method of claim 12, wherein the correlation is based on specific particles to be filtered by the disposable particulate filtration face mask.

14. The method of claim 7, wherein monitoring the reaction of the color changing indicator chemicals with one or more of water and carbon dioxide from the exhalation to determine the end of service life comprises comparing the color changing indicator chemicals to the reference strip.

15. The method of claim 7, wherein incorporating the color changing indicator chemicals on the interior surface of the disposable particulate filtration face mask comprises adding the color changing indicator chemicals to a nonwoven fabric particulate filtration material of the disposable particulate filtration face mask.

16. The method of claim 7, further comprising adding a plurality of different indicator chemicals to the disposable particulate filtration face mask, each of which is configured to react with a different particle; and determining a color change standard for each of the plurality of different indicator chemicals for indicating the end of service life of the disposable particulate filtration face mask based on accumulation of a particle corresponding to each of the plurality of different indicator chemicals.

* * * * *